US008274020B2

(12) United States Patent
Donarski et al.

(10) Patent No.: US 8,274,020 B2
(45) Date of Patent: Sep. 25, 2012

(54) APPARATUS AND METHOD OF CONTROLLING A TRIPLE HEATING ELEMENT OF A COOKING APPLIANCE

(75) Inventors: Robert S. Donarski, Stevensville, MI (US); Steven M. Swayne, Chattanooga, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 325 days.

(21) Appl. No.: 12/773,047

(22) Filed: May 4, 2010

(65) Prior Publication Data

US 2011/0272393 A1 Nov. 10, 2011

(51) Int. Cl.
*H05B 3/02* (2006.01)

(52) U.S. Cl. ..... 219/486; 219/483

(58) Field of Classification Search ..... 219/486, 219/483, 484, 398, 452.12
See application file for complete search history.

(56) References Cited

U.S. PATENT DOCUMENTS

| | | | | |
|---|---|---|---|---|
| 4,737,617 | A | 4/1988 | Payne | |
| 5,892,206 | A | 4/1999 | Higgins | |
| 5,961,867 | A | 10/1999 | McWilliams | |
| 6,693,262 | B2 * | 2/2004 | Gerola et al. | 219/462.1 |
| 6,995,344 | B2 * | 2/2006 | McWilliams | 219/448.17 |
| 2009/0294433 | A1 | 12/2009 | Thimm et al. | |

FOREIGN PATENT DOCUMENTS

| | | | |
|---|---|---|---|
| DE | 3825031 | A1 | 1/1990 |
| DE | 19801946 | C2 | 7/1999 |
| EP | 0256048 | B1 | 2/1988 |
| GB | 1213383 | | 11/1970 |
| GB | 2178914 | A | 2/1987 |
| GB | 2320374 | A | 6/1998 |
| GB | 2330255 | A | 4/1999 |
| GB | 2336255 | A | 10/1999 |
| JP | 3165483 | A | 7/1991 |
| JP | 2006162203 | A | 6/2006 |
| JP | 2008190834 | A | 8/2008 |
| WO | 2009/068133 | A1 | 6/2009 |

* cited by examiner

*Primary Examiner* — Charles Garber
*Assistant Examiner* — Reema Patel
(74) *Attorney, Agent, or Firm* — Jason S. Burnette; Barnes & Thornburg LLP

(57) ABSTRACT

A cooking appliance and method of operating the same is disclosed. The method includes energizing each of a first heating element, a second heating element, and a third heating element to a maximum power level to supply heat to a separately controlled cooking area, maintaining the second heating element at the maximum power level after a predetermined time interval has elapsed, and selectively energizing the first heating element and the third heating element to the maximum power level after the predetermined time interval has elapsed.

20 Claims, 4 Drawing Sheets

APPARATUS AND METHOD OF CONTROLLING A TRIPLE HEATING ELEMENT OF A COOKING APPLIANCE

TECHNICAL FIELD

The present disclosure relates generally to cooking appliances. The present disclosure relates more particularly to method of operating the heating elements of cooking appliances.

BACKGROUND

A cooking appliance is used to cook meals and other foodstuffs on a cooktop or within an oven. Cooking appliances typically include various control switches and electronics to control the heating elements of the cooking appliance.

SUMMARY

According to one aspect, a cooking appliance is disclosed. The cooking appliance includes a cooktop having a plurality of separately controlled cooking areas and a plurality of heating elements positioned below one of the separately controlled cooking areas. The plurality of heating elements include a first heating element, a second heating element, and a third heating element. The cooking appliance also includes an electronic controller electrically coupled to the plurality of heating elements. The electronic controller comprises a processor and a memory device electrically coupled to the processor. The memory device has stored therein a plurality of instructions which, when executed by the processor, cause the processor to energize each of the plurality of heating elements at a maximum power level for a predetermined time interval, maintain the second heating element at the maximum power level after the predetermined time interval has elapsed, and alternately energize the first heating element and the third heating element at the maximum power level after the predetermined time interval has elapsed such that the first heating element and the third heating element are not energized concurrently.

In some embodiments, the predetermined time interval may be about two minutes. In some embodiments, the cooking appliance may include a first relay electrically coupled to the first heating element and an electrical power supply, and a second relay electrically coupled to the third heating element and the electrical power supply. The electronic controller may be electrically coupled to the first relay and the second relay and the plurality of instructions, when executed by the processor, may cause the processor to open the second relay such that the third heating element is de-energized after the predetermined time interval has elapsed, and open the first relay and close the second relay after a second predetermined time interval has elapsed such the first heating element is de-energized and the third heating element is energized.

In some embodiments, the second predetermined time interval may be about fifteen seconds. In some embodiments, the cooking appliance may also include a thermal limiter coupled to the plurality of heating elements. The thermal limiter may be operable to de-energize the plurality of heating elements when the temperature of the separately controlled cooking area exceeds a specified temperature.

In some embodiments, each of the plurality of heating elements may have a maximum power rating of 1500 Watts. Additionally, in some embodiments, the first heating element may have a first outer diameter of six inches and may be arranged concentrically with the second heating element and the third heating element. In some embodiments, the second heating element may have a second outer diameter of nine inches, and the first heating element may be positioned within a first inner diameter of the second heating element. In some embodiments, the third heating element may have a third outer diameter of twelve inches, and the first heating element and the second heating element may be positioned within a second inner diameter of the third heating element.

According to another aspect, a method of operating a cooking appliance is disclosed. The method includes energizing a first heating element to a first maximum power level, a second heating element to a second maximum power level, and a third heating element to a third maximum power level for a predetermined time interval such that heat is supplied to a separately controlled cooking area, maintaining the second heating element at the second maximum power level after the predetermined time interval has elapsed, and alternately energizing the first heating element to the first maximum power level and the third heating element to the third maximum power level after the predetermined time interval has elapsed. In some embodiments, the predetermined time interval may be about two minutes.

In some embodiments, alternately energizing the first heating element to the first maximum power level may include energizing the first heating element and deenergizing the third heating element for a second predetermined time interval, and deenergizing the first heating element and energizing the third heating element after the second predetermined time interval has elapsed. In some embodiments, the second predetermined time interval may be about fifteen seconds.

In some embodiments, the first maximum power level, the second maximum power level, and the third maximum power level may be equal. In some embodiments, each of the first heating element, the second heating element, and the third heating element may have a maximum power rating of 1500 Watts.

In some embodiments, the method may include measuring the temperature of the separately controlled cooking area, and deenergizing the first heating element, the second heating element, and the third heating element when the temperature of the separately controlled cooking area exceeds a specified temperature. In some embodiments, the specified temperature may be approximately 600 degrees Celsius.

According to another aspect, the method includes energizing each of a first heating element, a second heating element, and a third heating element to a maximum power level to supply heat to a separately controlled cooking area, maintaining the first heating element and the second heating element at the maximum power level and deenergizing the third heating element after a first predetermined time interval has elapsed, deenergizing the first heating element and energizing the third heating element to the maximum power level after a second predetermined time interval has elapsed, and energizing the first heating element to the maximum power level and deenergizing the third heating element after a third predetermined time interval has elapsed.

In some embodiments, the second predetermined time interval may be equal to the third predetermined time interval. In some embodiments, the first predetermined time interval may be about two minutes.

BRIEF DESCRIPTION OF THE DRAWINGS

The detailed description particularly refers to the following figures, in which.

DETAILED DESCRIPTION OF THE DRAWINGS

Figure 1:
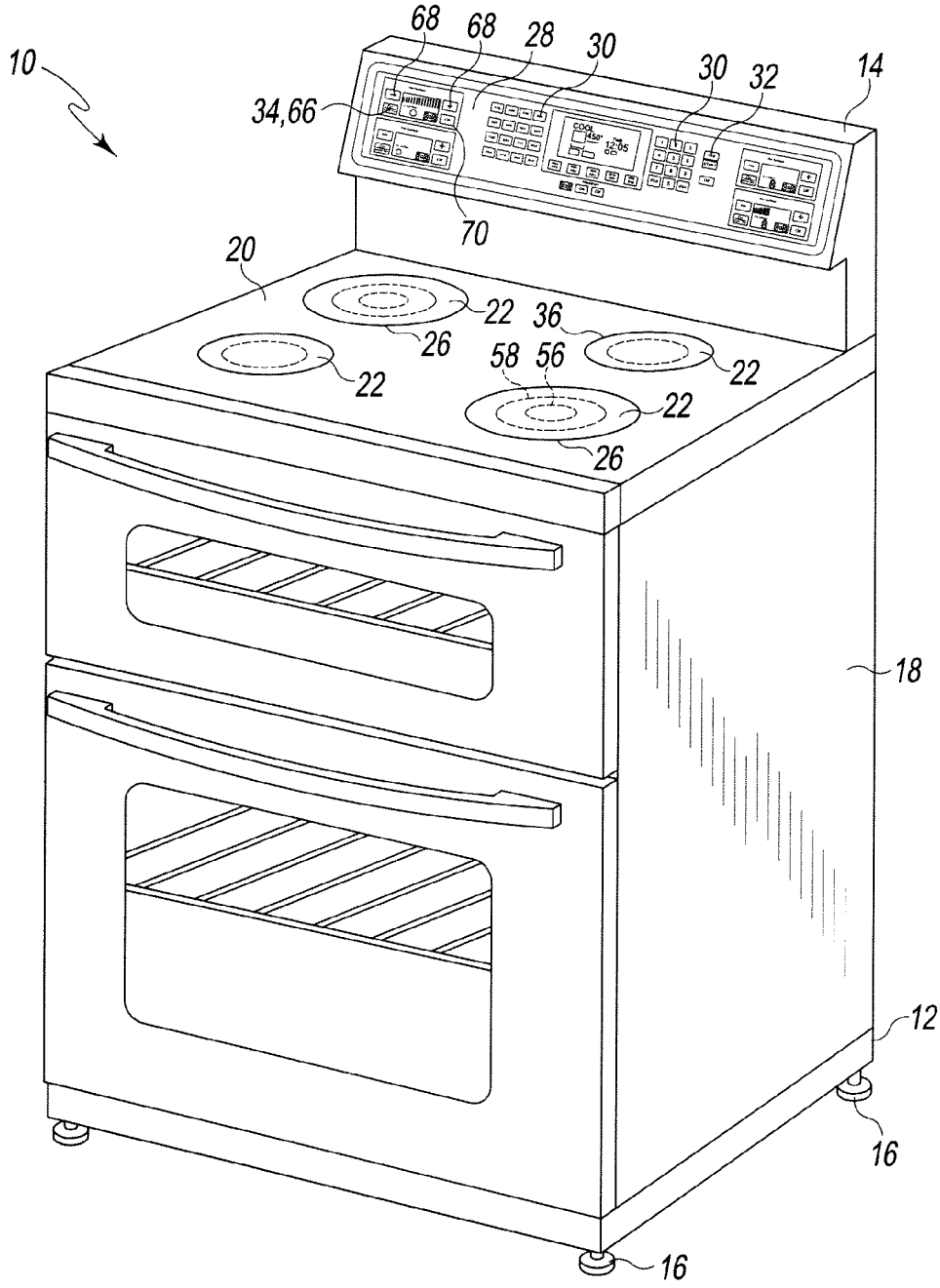
FIG. 1 is a perspective view of a cooking appliance.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a cooking appliance 10 is shown. The cooking appliance 10 includes a lower frame 12 and an upper panel 14. The lower frame 12 includes a number of legs 16 extending downwardly from the lower frame 12. The legs 16 are located in each corner of the lower frame 12 and are adjustable to allow the user to level the cooking appliance 10 to compensate for any tilt or angle of the floor surface.

A housing 18 extends upwardly from the lower frame 12 to the upper panel 14. A cooktop 20 is secured to the housing 18 below the upper panel 14. As shown in FIG. 1, the cooktop 20 is a glass-ceramic cooktop. The cooktop 20 has a plurality of separately controlled cooking areas 22. It should be appreciated that the term "separately controlled cooking area" as used herein refers to a location of the cooktop that may be operated by the user independently from the remainder of the cooktop. A separately controlled cooking area may have a heating element or other heating device dedicated to supplying heat to it. The heat supplied to each separately controlled heating area is controlled such that a command to change the heat supplied to it does not change the amount of heat supplied to any other separately controlled cooking area. In the illustrative embodiment of FIG. 1, the cooktop 20 has four separately controlled cooking areas 22.

A heating device 24 (see FIG. 2) is positioned below each separately controlled cooking area 22. Each heating device 24 is operable to heat only the corresponding separately controlled cooking area 22 to desired cooking temperatures. An outer perimeter 26 designates to the user where the user should place pots, pans, and the like to be heated by each separately controlled cooking area 22.

A control surface 28 having a number of controls 30 is positioned on the upper panel 14. A user may separately control the amount of heat supplied to each of the plurality of separately controlled cooking areas 22 using a set of touch-sensitive control buttons 32 positioned on the control surface 28. For example, if the user presses an "ON" control 34, an electrical output signal is generated indicative of the user input. An electronic controller 80 (see FIG. 2) electrically coupled with the control surface 28 receives that electrical output signal and controls the operation of the corresponding heating device 24 to change the temperature of one of the plurality of separately controlled cooking areas 22. It will be appreciated that in other embodiments the controls 30 may take the form of switches, dials, touch-screens, or other devices configured to receive user-input.

Figure 2:
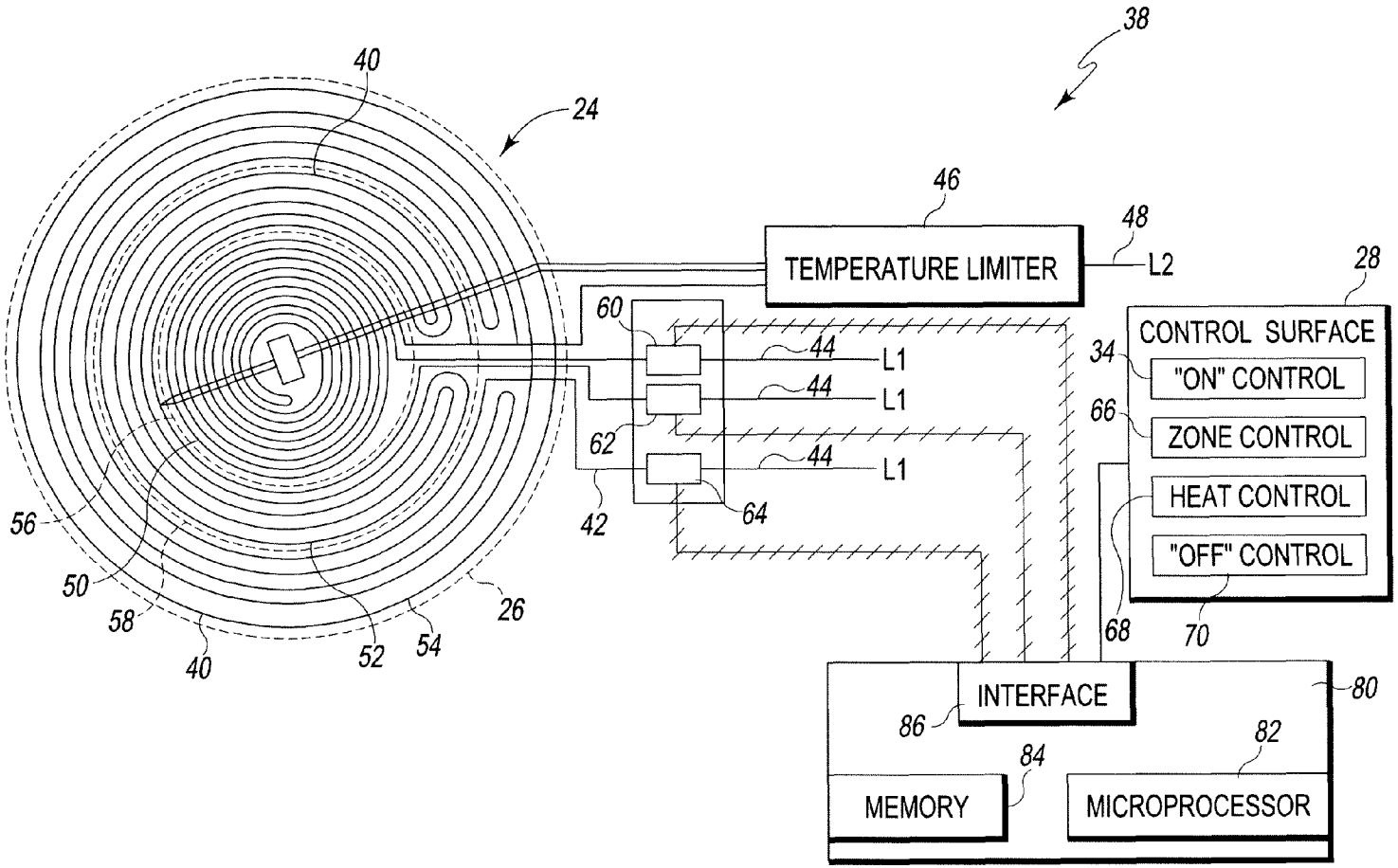
FIG. 2 is a simplified block diagram of one illustrative embodiment of a control system for the cooking appliance of FIG. 1.

Referring to FIG. 2, a simplified block diagram of an illustrative control system 38 for the cooking appliance 10 is shown. One of the heating devices 24, which is position below one of the separately controlled cooking areas 22, is shown in greater detail. The heating device 24 includes a plurality of resistive heating elements 40 that fit generally within the outer perimeter 26. When energized with electrical power generated by an electrical power supply (not shown), each of the heating elements 40 generates heat that is supplied to the corresponding separately controlled cooking area 22, thereby raising the temperature of the cooktop 20. A relay box 42 is positioned between the heating elements 40 and electrical line 44 ("L1") of the electrical power supply, and a temperature or thermal limiter 46 is positioned between each heating element 40 and an electrical line 48 ("L2") of the electrical power supply. As will be discussed in greater detail, the relay box 42 and the thermal limiter 46 are operable to regulate the electrical power supplied to the heating elements 40.

In the embodiment of FIG. 2, the plurality of heating elements 40 include an inner heating element 50, a middle heating element 52, and an outer heating element 54. As embodied in FIG. 2, the outer diameters of the heating elements 50, 52, 54 are approximately six, nine, and twelve inches, respectively. It should be appreciated that in other embodiments the heat elements 40 may have different outer diameters.

The heating elements 40 are arranged in a substantially concentric pattern such that each of the heating elements 40 supplies heat to a specific portion or zone of the corresponding separately controlled cooking area when energized. In the illustrative embodiment, the separately controlled cooking area 22 is divided into three heating zones that roughly correspond in size to the outer diameter of each of the heating elements. For example, by energizing only the inner heating element 50, heat may be supplied to a single heating zone 56, which roughly corresponds to the outer diameter of the inner heating element 50 (i.e., six inches). By energizing the heating elements 50, 52 together, heat may be supplied to a larger dual heating zone 58 that roughly corresponds to the outer diameter of the heating element 52 (i.e., nine inches). When all three heating elements 50, 52, 54 are energized together, heat is supplied to a triple heating zone that effectively encompasses the entire separately controlled cooking area 22.

In the illustrative embodiment, each of the heating elements 40 may be energized to a maximum power level of 1500 Watts. As used herein, the term "maximum power level" is defined as the maximum electrical power output of the heating element. The maximum power level indicates the power rating of the heating element. For example, a heating element having a power rating of 1500 Watts may be energized to a maximum power level of 1500 Watts. Thus, in the illustrative embodiment, when the inner heating element 50, the middle heating element 52, and the outer heating element 54 are energized together to their respective maximum power levels, the heating device 24 yields a total of 4500 Watts. It will be appreciated that in other embodiments the maximum power level of each of the heating elements 40 may be less than or greater 1500 Watts. Additionally, in other embodiments, each of the heating elements 40 may not have the same maximum power level such that, for example, the inner heating element 50 may have a maximum power level less than that of the outer heating element 54.

The thermal limiter 46 coupled to the heating elements 40 is operable to measure the temperature of the separately controlled cooking area 22. In some embodiments, the cooking appliance 10 may include a separate temperature sensor to measure the temperature of the separately controlled cooking area 22, which is then relayed to a thermal limiter. Additionally, in some embodiments, the thermal limiter 46 may be a component of the heating device 24 that is installed below the separately controlled cooking area 22.

When the temperature measured by the thermal limiter 46 exceeds a specified temperature, the thermal limiter 46 severs the connection between the electrical power supply (i.e., line 48) and the heating elements 40, which de-energizes the heating elements 40. In that way, the thermal limiter 46 prevents the heating device 24 from subjecting the separately controlled cooking area 22 to temperatures that would damage the glass-ceramic cooktop 20. When the measured temperature drops below the specified temperature, the thermal limiter 46 reconnects the heating elements 40 to the electrical power supply, thereby allowing the heating elements 40 to generate and supply heat to the separately controlled cooking area 22. In the illustrative embodiment, the specified temperature is approximately 600° C.

As discussed above, the relay box 42 is positioned between the heating elements 40 and the electrical lines 44. The relay box 42 includes electrically-operated relays or relay switches 60, 62, 64 that may be selectively opened and closed to regulate the electrical power supplied to the heating elements 40. For example, when relay switch 60 is closed, the inner heating element 50 is connected with its corresponding line 44 and is energized with electrical power from the electrical power supply. When the relay switch 60 is opened, the inner heating element 50 is disconnected from its corresponding line 44, thereby severing the supply of electrical power to the heating element 50. Because each of the relay switches 60, 62, 64 is controlled independently, the state of one of the relay switch does not affect the operation of the other relay switches. In that way, each of the heating elements 40 is controlled separately such that one or more of the heating elements 40 may be energized at any time. In some embodiments, each relay switch 60, 62, 64 may be an electromagnetic relay switch, which opens and closes in response to a control signal.

The cooking appliance 10 also includes an electronic control unit (ECU) or "electronic controller" 80. The electronic controller 80 may be positioned in the upper panel 14 or within the housing 18 of the cooking appliance 10. The electronic controller 80 is, in essence, the master computer responsible for interpreting electrical signals sent by sensors associated with the cooking appliance 10 and for activating or energizing electronically-controlled components associated with the cooking appliance 10. For example, the electronic controller 80 is configured to control the operation of the various components of the cooking appliance 10, including the relay switches 60, 62, 64. The electronic controller 80 also monitors various signals from the control surface 28 and determines when various operations of the cooking appliance 10 should be performed. As will be described in more detail below with reference to FIGS. 3 and 4, the electronic controller 80 is operable to control the components of the cooking appliance 10 such that when the user touches one of the controls 30 located on the control surface 28, the cooking appliance 10 activates the appropriate heating device 24 and operates the heating elements 40 of the heating device 24 to generate the amount of heat desired by the user.

To do so, the electronic controller 80 includes a number of electronic components commonly associated with electronic units utilized in the control of electromechanical systems. For example, the electronic controller 80 may include, amongst other components customarily included in such devices, a processor such as a microprocessor 82 and a memory device 84 such as a programmable read-only memory device ("PROM") including erasable PROM's (EPROM's or EEPROM's). The memory device 84 is provided to store, amongst other things, instructions in the form of, for example, a software routine (or routines) which, when executed by the microprocessor 82, allows the electronic controller 80 to control operation of the cooking appliance 10.

The electronic controller 80 also includes an analog interface circuit 86. The analog interface circuit 86 converts the output signals from various sensors and other components into signals which are suitable for presentation to an input of the microprocessor 82. In particular, the analog interface circuit 86, by use of an analog-to-digital (A/D) converter (not shown) or the like, converts the analog signals generated by the sensors into digital signals for use by the microprocessor 82. It should be appreciated that the A/D converter may be embodied as a discrete device or number of devices, or may be integrated into the microprocessor 82. It should also be appreciated that if any one or more of the sensors or other components associated with the cooking appliance 10 generate a digital output signal, the analog interface circuit 86 may be bypassed.

Similarly, the analog interface circuit 86 converts signals from the microprocessor 82 into output signals that are suitable for presentation to the electrically-controlled components associated with the cooking appliance 10 (e.g., the relay switches 60, 62, 64). In particular, the analog interface circuit 86, by use of a digital-to-analog (D/A) converter (not shown) or the like, converts the digital signals generated by the microprocessor 82 into analog signals for use by the electronically-controlled components associated with the cooking appliance 10. It should be appreciated that, similar to the A/D converter described above, the D/A converter may be embodied as a discrete device or number of devices, or may be integrated into the microprocessor 82. It should also be appreciated that if any one or more of the electronically-controlled components associated with the cooking appliance 10 operate on a digital input signal, the analog interface circuit 86 may be bypassed.

Thus, the electronic controller 80 may control the operation of the cooking appliance 10 in accordance with the user-input received via the control surface 28. In particular, the electronic controller 80 executes a routine including, amongst other things, a control scheme in which the electronic controller 80 receives the user-input from the control surface 28 and electronically controls the operation of the relay switches 60, 62, 64. To do so, the electronic controller 80 performs numerous calculations, either continuously or intermittently, including accessing values in preprogrammed look-up tables, in order to execute algorithms to control the opening and closing of each of the relay switches 60, 62, 64 to generate the desired amount of heat at the corresponding separately controlled heating areas 22.

As will be appreciated by those of the skill in the art, the cooking appliance 10 may include elements other than those shown and described above, such as, by way of example, additional separately controlled cooking areas. The cooking appliance 10 may also include a variety of other sensors, such as, for example, an additional temperature sensor to provide temperature data to the electronic controller 80. While the cooking appliance 10 is embodied as a free-standing range, it should also be appreciated that cooking appliance 10 may be, for example, cooktop configured to be placed in a kitchen counter.

To operate the cooking appliance 10, the user accesses the controls 30 positioned on the control surface 28. In the illustrative embodiment, the user touches the "ON" control 34 to activate the heating device 24 associated with one of the separately controlled cooking areas 22. As discussed above, the separately controlled cooking area 22 is divided into three heating zones that roughly correspond in size to the outer diameter of each of the heating elements 40. The user may touch a zone control 66 to adjust the size of the heating zone currently active in the separately controlled cooking areas 22. For example, the user may touch the zone control 66 to select the single heating zone 56 as the current zone, and the cooking appliance 10 will respond by energizing only the inner heating element 50. As shown in FIG. 1, the zone control 66 and the "ON" control 34 are the same button. It will be appreciated that in other embodiments each control may be linked to a different button.

The user may input a desired quantity of heat by touching a heat control 68, and the cooking appliance 10 will respond by supplying electrical power to the appropriate heating element(s) 40 so as to generate the user-desired quantity of heat at the separately controlled cooking area 22. As described above, if the temperature of the cooktop 20 exceeds a specified temperature, the thermal limiter 46 will sever the connection between the heating elements 50, 52, 54 and the electrical power supply independent of the electronic controller 80. To turn off the heating device 24, the user may touch an "Off" control 70 positioned on the control surface 28.

Figure 3:
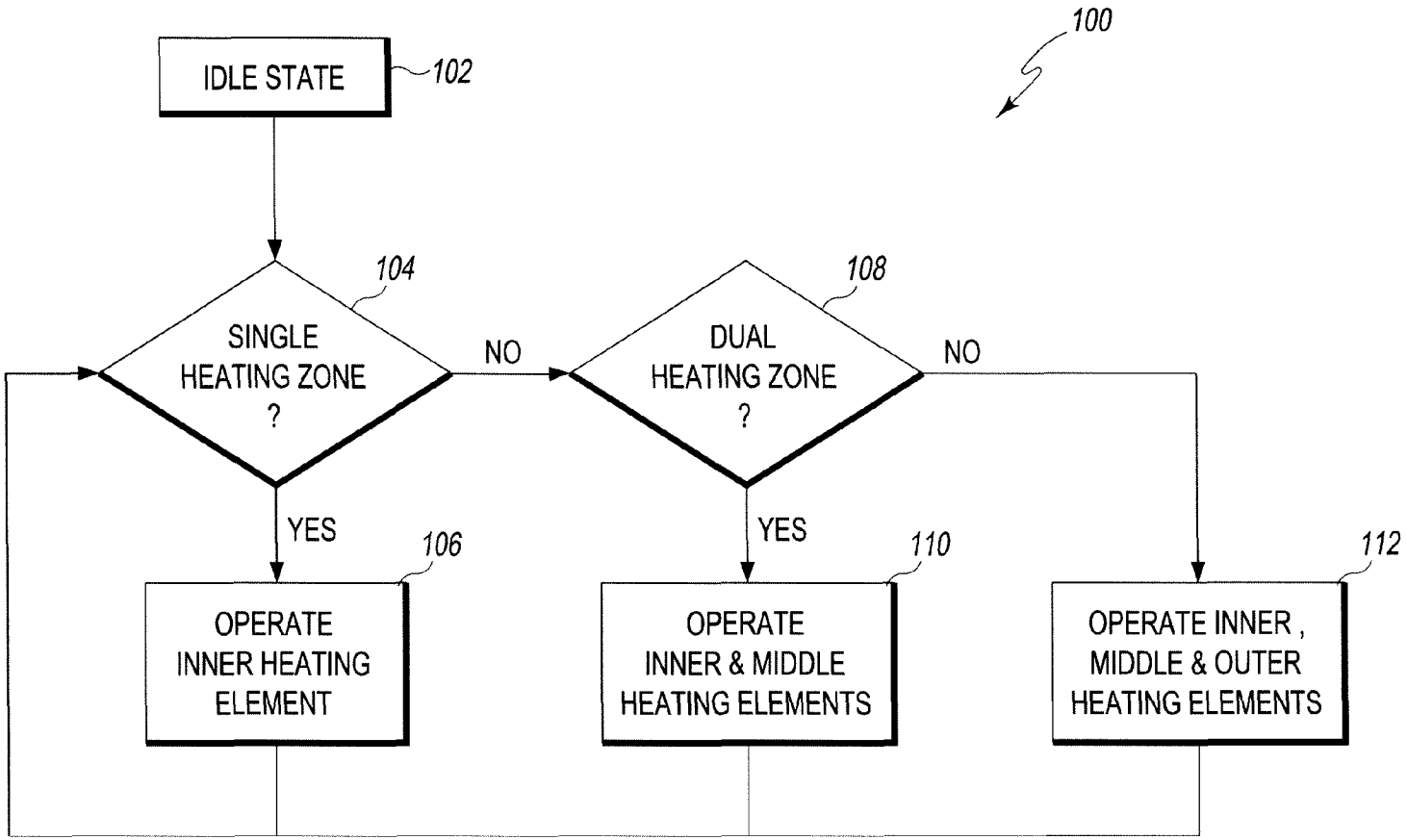
FIG. 3 is a simplified flow chart of a control routine for operating a heating device of the cooking appliance of FIG. 1.

Referring now to FIG. 3, a simplified block diagram illustrates a control routine 100 for operating the cooking appliance 10. When the user first accesses the control surface 28, the cooking appliance 10 is in an idle state (step 102). As discussed above, when the user presses any of the controls 30 located on the control surface 28, an electrical output signal is generated indicative of the user-input. When the user touches any of the "ON" controls 34, the electronic controller 80 executes an initialization process in which the electronic controller 80 identifies the separately controlled cooking area 22 corresponding to the touched control 34 and conducts a status check of the various components of the cooking appliance 10. At the completion of the initialization process, the electronic controller 80 is ready to operate the heating device 24 associated with the user-selected separately controlled cooking area 22. The routine 100 then advances to step 104.

In step 104, the electronic controller 80 determines whether the user has selected the single heating zone 56 as the current heating zone. To do this, the electronic controller 80 compares the electrical output signal generated by zone control 66 to a look-up table from a plurality of look-up tables stored in the memory device 84. When the electronic controller 80 determines that the single heating zone 56 has been selected as the current heating zone, the routine 100 advances to step 106. When the electronic controller 80 determines that the current heating zone is not the single heating zone 56, the routine 100 advances to step 108.

In step 106, the electronic controller 80 operates the inner heating element 50 to supply the user-desired quantity of heat to the single heating zone 56 of the separately controlled cooking area 22. As discussed above, the user touches the heat control 68 to enter a desired quantity of heat for the separately controlled heating area 22. When the electrical output signal from the heat control 68 is received, the electronic controller 80 determines the amount of electrical power that should be supplied to the inner heating element 50 to generate the desired quantity of heat.

The electronic controller 80 then operates the relay switch 60 to supply electrical power to the inner heating element 50. Electrical power may be supplied to the inner heating element 50 continuously or on a periodic basis according to a predetermined duty cycle, depending on the user-desired quantity of heat. When electrical power is supplied continuously to the heating element 50, the heating element 50 is energized to its maximum power rating. When electrical power is supplied to the heating element 50 according to a predetermined duty cycle, the relay switch 60 is opened and closed on a periodic basis to generate the user-desired quantity of heat. When the electronic controller 80 receives a new electrical output signal from the zone control 66, the routine 100 returns to step 104.

Returning to step 104, when the electronic controller 80 determines that the current heating zone is not the single heating zone 56, the routine 100 advances to step 108. In step 108, the electronic controller 80 determines whether the user has touched the zone control 66 to select the dual heating zone 58 as the current heating zone. To do this, the electronic controller 80 compares the electrical output signal generated by the zone control 66 to the look-up table stored in the memory device 84. When the electronic controller 80 determines that the dual heating zone 58 has been selected by the user as the current heating zone, the routine 100 advances to step 110. When the electronic controller 80 determines that the current heating zone is not the dual heating zone 58, the routine 100 advances to step 112.

In step 110, the electronic controller 80 operates the inner heating element 50 and the middle heating element 52 to supply the user-desired quantity of heat to the dual heating zone 58 of the separately controlled cooking area 22. After receiving the electrical output signal generated by the heat control 68, the electronic controller 80 determines the amount of electrical power required for the heating elements 50, 52 to generate the user-desired quantity of heat.

The electronic controller 80 then operates the relay switches 60, 62 to supply the required electrical power to the heating elements 50, 52. As with the single heating zone 56, electrical power may be supplied to the heating elements 50, 52 continuously or on a periodic basis according to a predetermined duty cycle, depending on the user-desired quantity of heat. When the electronic controller 80 receives a new electrical output signal from the zone control 66, the routine 100 goes back to step 104.

Returning to step 108, when the electronic controller 80 determines that the current heating zone is not the dual heating zone 58, the routine 100 advances to step 112. In step 112, the electronic controller 80 operates the inner heating element 50, the middle heating element 52, and the outer heating element 54 to supply the user-desired quantity of heat to the separately controlled cooking area 22. After receiving the electrical output signal generated by the heat control 68, the electronic controller 80 determines the amount of electrical power required for the heating elements 50, 52, 54 to generate the user-desired quantity of heat. The electronic controller 80 then operates the relay switches 60, 62, 64 to supply the required electrical power to the heating elements 50, 52, 54. As with the single and dual heating zones, electrical power may be supplied to the heating elements 50, 52, 54 continuously or on a periodic basis according to a predetermined duty cycle, depending on the user-desired quantity of heat. When the electronic controller 80 receives a new electrical output signal from the zone control 66, the routine 100 returns to step 104.

Figure 4:
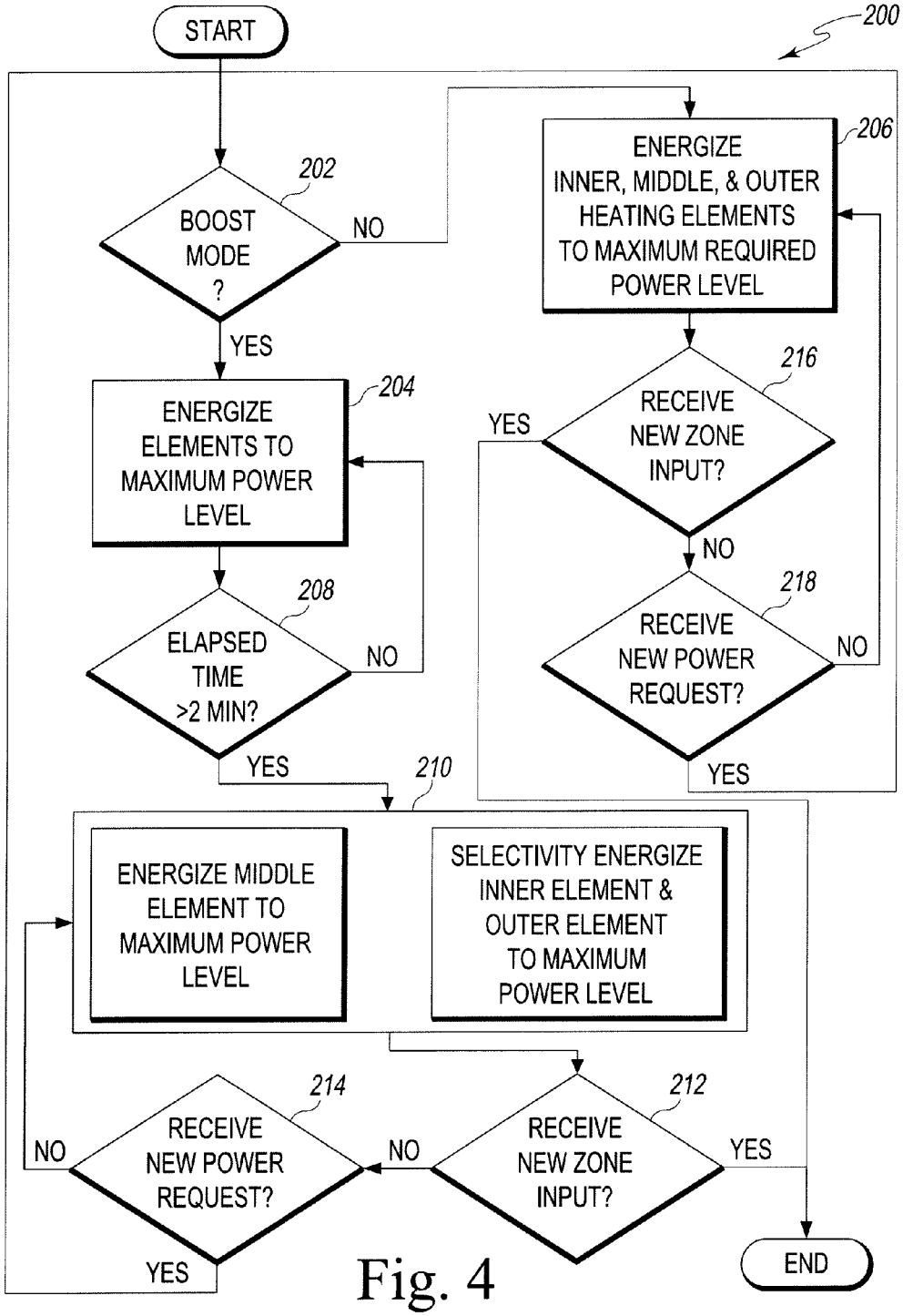
FIG. 4 is a simplified flow chart of a sub-routine for operating three heating elements in the control routine of FIG. 3.

Referring now to FIG. 4, an illustrative embodiment of a sub-routine for operating the inner heating element 50, the middle heating element 52, and the outer heating element 54 in step 112 of the routine 100 is shown. The sub-routine (hereinafter sub-routine 200) begins with step 202 in which the electronic controller 80 determines whether to operate the heating elements 50, 52, 54 in a boost mode. To do this, the electronic controller 80 compares the electrical output signal generated by the heat control 68 to a look-up table associated with the triple-heating zone. When the electrical output signal indicates that the user-desired quantity of heat is the maximum quantity of heat generated by the combined operation of the heating elements 50, 52, 54, the electronic controller 80 engages the boost mode, and the sub-routine 200 proceeds to step 204. When the electrical output signal from the heat control 68 indicates that the user-desired quantity of heat is less than the maximum quantity of heat, the sub-routine 200 advances to step 206.

In step 204, the electronic controller 80 operates the relay switches 60, 62, 64 to continuously supply electrical power to the heating elements 50, 52, 54. The electronic controller 80 generates an electrical control signal that is received by the relay switches 60, 62, 64. Each of the relay switches 60, 62, 64 closes in response to receiving the electrical control signal, thereby connecting the heating elements 50, 52, 54 with their respective electrical lines 44 and energizing the heating elements 50, 52, 54 to their respective maximum power levels. As discussed above, the heating elements 50, 52, 54 of the illustrative embodiment produce 4500 Watts of heat when energized together at maximum power. The sub-routine 200 then advances to step 208.

In step 208, a timer is incremented and the electronic controller 80 determines whether a predefined time interval has elapsed. As shown in FIG. 4, the predefined time interval is about two minutes. While the timer indicates that the predefined time interval has not elapsed, electrical power continues to be supplied to the heating elements 50, 52, 54. When the predefined time interval has elapsed, the sub-routine 200 advances to step 210.

In step 210, the electronic controller 80 operates the middle heating element 52 at its maximum power level while alternately operating the inner heating element 50 and the outer heating element 54 at maximum power. In that way, the inner heating element 50 and the outer heating element 54 are not energized concurrently in step 210. To do this, the electronic controller 80 sends an electronic control signal to the relay switch 64 to open the relay switch 64 and sever the connection between the outer heating element 54 and the electrical power supply. The relay switches 60, 62 remain closed such that the inner heating element 50 and middle heating element 52 are energized with maximum power.

After a predefined time interval, the electronic controller 80 sends an electronic control signal to the relay switch 60 to open the relay switch 60 and sever the connection between the inner heating element 50 and the electrical power supply. The electronic controller 80 sends another electronic control signal to the relay switch 64 to close the relay switch 64 and reconnect the outer heating element 54 and the electrical power supply. The relay switches 62, 64 then remain closed such that the middle heating element 52 and the outer heating element 54 are energized with maximum power.

After the predefined time interval has elapsed for a second time, the electronic controller 80 reverses the process, deenergizing the outer heating element 54 and energizing the inner heating element 50. Unless a new user-input is received from the control surface 28, the electronic controller 80 maintains the middle heating element 52 at its maximum power level and alternately operates the inner heating element 50 and the outer heating element 54 at maximum power.

In the illustrative embodiment, the predefined time interval over which the heating elements 50, 54 are alternately operated is fifteen seconds. It will be appreciated that in other embodiments the predefined time interval may be more or less depending on the power rating associated with the heating elements 50, 52, 54 and the temperature rating of the cooktop 20. While the predefined time interval for the inner heating element 50 and the outer heating element 54 is the same in the illustrative embodiment, the time interval associated with each heating element may be different in other embodiments such that, for example, the inner heating element 50 is alternately energized longer than the outer heating element 54.

Additionally, in the illustrative embodiment, the outer heating element 54 is de-energized first. It will be appreciated that in other embodiments the inner heating element 50 may be de-energized first while the outer heating element 54 remains connected to the electrical power supply. In other embodiments, the middle heating element 52 may be alternately energized and de-energized while another of the heating elements is maintained at maximum power.

While the electronic controller 80 continues to operate the middle heating element 52 and alternately operate the heating elements 50, 54, the sub-routine 200 advances to step 212, and the electronic controller 80 monitors for new user-input. In step 212, the electronic controller 80 determines whether a new electrical output signal has been received from the zone control 66. When the electronic controller 80 determines that a new electrical output signal has been received from the zone control 66, the sub-routine 200 ends and the routine 100 returns to step 104. When the electronic controller 80 has not received a new electrical output signal from the zone control 66, the sub-routine 200 advances to step 214.

In step 214, the electronic controller 80 determines whether a new electrical output signal has been received from the heat control 68. When the electronic controller 80 determines that a new electrical output signal has been received from the heat control 68, the sub-routine 200 returns to step 202. When the electronic controller 80 has not received a new electrical output signal from the heat control 68, the sub-routine 200 returns to step 210.

Returning to step 202, when the electrical output signal from the heat control 68 indicates that the user-desired quantity of heat is less than the maximum quantity of heat, the sub-routine 200 advances to step 206. In step 206, the electronic controller 80 determines the amount of electrical power that must be supplied to the heating elements 50, 52, 54 such that the user-desired quantity of heat is generated. To do this, the electronic controller 80 selects a look-up table associated with the triple heating zone from the plurality of look-up tables stored in the memory device 84. Using the particular look-up table associated with the triple heating zone, the electronic controller 80 selects the amount of electrical power corresponding to the user-desired quantity of heat. The electronic controller 80 then operates the relay switches 60, 62, 64 to supply the required electrical power to the heating elements 50, 52, 54. The sub-routine 200 then advances to step 216.

In step 216, the electronic controller 80 determines whether a new electrical output signal has been received from the zone control 66. When the electronic controller 80 determines that a new electrical output signal has been received from the zone control 66, the sub-routine 200 ends, and the routine 100 returns to step 104. When the electronic controller 80 has not received a new electrical output signal from the zone control 66, the sub-routine 200 advances to step 218.

In step 218, the electronic controller 80 determines whether a new electrical output signal has been received from the heat control 68. When the electronic controller 80 determines that a new electrical output signal has been received from the heat control 68, the sub-routine 200 returns to step 202. When the electronic controller 80 has not received a new electrical output signal from the heat control 68, the sub-routine 200 returns to step 206.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A cooking appliance comprising:

a cooktop including a plurality of separately controlled cooking areas, a plurality of heating elements positioned below one of the separately controlled cooking areas, the plurality of heating elements including a first heating element, a second heating element, and a third heating element, and an electronic controller electrically coupled to the plurality of heating elements, the controller comprising (i) a processor, and (ii) a memory device electrically coupled to the processor, the memory device having stored therein a plurality of instructions which, when executed by the processor, cause the processor to:

(a) energize each of the plurality of heating elements at a maximum power level for a predetermined time interval, (b) maintain the second heating element at the maximum power level after the predetermined time interval has elapsed, and (c) alternately energize the first heating element and the third heating element at the maximum power level after the predetermined time interval has elapsed such that the first heating element and the third heating element are not energized concurrently.

2. The cooking appliance of claim 1, wherein the predetermined time interval is about two minutes.

3. The cooking appliance of claim 1, further comprising:

a first relay electrically coupled to the first heating element and an electrical power supply, and a second relay electrically coupled to the third heating element and the electrical power supply, wherein the electronic controller is electrically coupled to the first relay and the second relay and the plurality of instructions, when executed by the processor, cause the processor to:

(a) open the second relay such that the third heating element is de-energized after the predetermined time interval has elapsed, and (b) open the first relay and close the second relay after a second predetermined time interval has elapsed such the first heating element is de-energized and the third heating element is energized.

4. The cooking appliance of claim 3, wherein the second predetermined time interval is about fifteen seconds.

5. The cooking appliance of claim 1, further comprising:

a thermal limiter coupled to the plurality of heating elements, the thermal limiter being operable to de-energize the plurality of heating elements when the temperature of the separately controlled cooking area exceeds a specified temperature.

6. The cooking appliance of claim 1, wherein each of the plurality of heating elements has a maximum power rating of 1500 Watts.

7. The cooking appliance of claim 1, wherein the first heating element has a first outer diameter of six inches and is arranged concentrically with the second heating element and the third heating element.

8. The cooking appliance of claim 7, wherein the second heating element has a second outer diameter of nine inches and the first heating element is positioned within a first inner diameter of the second heating element.

9. The cooking appliance of claim 7, wherein:

the third heating element has a third outer diameter of twelve inches, and the first heating element and the second heating element are positioned within a second inner diameter of the third heating element.

10. A method of operating a cooking appliance, comprising:

energizing a first heating element to a first maximum power level, a second heating element to a second maximum power level, and a third heating element to a third maximum power level for a predetermined time interval such that heat is supplied to a separately controlled cooking area, maintaining the second heating element at the second maximum power level after the predetermined time interval has elapsed, and alternately energizing the first heating element to the first maximum power level and the third heating element to the third maximum power level after the predetermined time interval has elapsed.

11. The method of claim 10, wherein the predetermined time interval is about two minutes.

12. The method of claim 10, wherein alternately energizing the first heating element to the first maximum power level includes:

energizing the first heating element and deenergizing the third heating element for a second predetermined time interval, and deenergizing the first heating element and energizing the third heating element after the second predetermined time interval has elapsed.

13. The method of claim 12, wherein the second predetermined time interval is about fifteen seconds.

14. The method of claim 10, wherein the first maximum power level, the second maximum power level, and the third maximum power level are equal.

15. The method of claim 14, wherein each of the first heating element, the second heating element, and the third heating element has a maximum power rating of 1500 Watts.

16. The method of claim 10, further comprising:

measuring the temperature of the separately controlled cooking area, and de-energizing the first heating element, the second heating element, and the third heating element when the temperature of the separately controlled cooking area exceeds a specified temperature.

17. The method of claim 16, wherein the specified temperature is approximately 600 degrees Celsius.

18. A method of operating a cooktop, comprising:

energizing each of a first heating element, a second heating element, and a third heating element to a maximum power level to supply heat to a separately controlled cooking area, maintaining the first heating element and the second heating element at the maximum power level and deenergizing the third heating element after a first predetermined time interval has elapsed, deenergizing the first heating element and energizing the third heating element to the maximum power level after a second predetermined time interval has elapsed, and energizing the first heating element to the maximum power level and deenergizing the third heating element after a third predetermined time interval has elapsed.

19. The method of claim 18, wherein the second predetermined time interval is equal to the third predetermined time interval.

20. The method of claim 18, wherein the first predetermined time interval is about two minutes.

* * * * *